US009138634B2

(12) United States Patent
Moody

(10) Patent No.: US 9,138,634 B2
(45) **Date of Patent: *Sep. 22, 2015**

(54) CASINO GAME WITH NEXT ROUND MULTIPLIERS

(75) Inventor: Ernest W. Moody, Las Vegas, NV (US)

(73) Assignee: IGT, Las Vegas, NV (US)

( * ) Notice: Subject to any disclaimer, the term of this patent is extended or adjusted under 35 U.S.C. 154(b) by 1127 days.

This patent is subject to a terminal disclaimer.

(21) Appl. No.: 11/958,570

(22) Filed: Dec. 18, 2007

(65) Prior Publication Data

US 2008/0146305 A1 Jun. 19, 2008

Related U.S. Application Data

(60) Provisional application No. 60/875,812, filed on Dec. 18, 2006, provisional application No. 60/986,627, filed on Nov. 9, 2007.

(51) Int. Cl.

| | |
|---|---|
| ***A63F 9/24*** | (2006.01) |
| ***A63F 1/00*** | (2006.01) |
| ***G07F 17/32*** | (2006.01) |

(52) U.S. Cl.

CPC . *A63F 1/00* (2013.01); *G07F 17/32* (2013.01); *G07F 17/3244* (2013.01); *G07F 17/3267* (2013.01)

(58) Field of Classification Search

CPC ..... G07F 17/32
USPC ..... 463/13, 16; 273/292
See application file for complete search history.

(56) References Cited

U.S. PATENT DOCUMENTS

| | | | | |
|---|---|---|---|---|
| 5,167,413 | A | | 12/1992 | Fulton |
| 5,251,897 | A | | 10/1993 | Fulton |
| 5,322,295 | A | | 6/1994 | Cabot et al. |
| 5,332,219 | A | * | 7/1994 | Marnell et al. ..... 463/13 |
| 5,374,067 | A | | 12/1994 | Jones |
| 5,411,257 | A | | 5/1995 | Fulton |
| 5,431,408 | A | | 7/1995 | Adams |
| 5,437,451 | A | | 8/1995 | Fulton |
| 5,531,448 | A | | 7/1996 | Moody |
| 5,636,842 | A | | 6/1997 | Cabot et al. |
| 5,732,950 | A | | 3/1998 | Moody |
| 5,755,621 | A | | 5/1998 | Marks et al. |
| 5,803,809 | A | | 9/1998 | Yoseloff |
| 5,820,460 | A | | 10/1998 | Fulton |
| 5,823,873 | A | | 10/1998 | Moody |
| 5,833,536 | A | | 11/1998 | Davids et al. |
| 5,833,537 | A | | 11/1998 | Barrie |
| 5,873,823 | A | | 2/1999 | Eidelberg et al. |
| 5,882,259 | A | | 3/1999 | Holmes, Jr. et al. |
| 5,911,418 | A | | 6/1999 | Adams |
| 5,954,335 | A | | 9/1999 | Moody |
| 5,957,774 | A | | 9/1999 | Holmes, Jr. et al. |

(Continued)

*Primary Examiner* — Omkar Deodhar
(74) *Attorney, Agent, or Firm* — Neal, Gerber & Eisenberg LLP

(57) ABSTRACT

A player plays a first round of a casino game. If the player achieves a winning outcome on the first round of play, the payouts for the next round of play of the casino game will be increased. The amount of the increase is based on the category of the winning outcome on the first round of play. Each subsequent round of play continues to have increased payouts if the player continues to achieve winning outcomes. When the player has a losing outcome, the payouts revert to the base level. An extra wager may be required from the player to activate this feature during the play of the casino game.

18 Claims, 4 Drawing Sheets

(56) References Cited

U.S. PATENT DOCUMENTS

| | | | | |
|---|---|---|---|---|
| 6,007,066 | A | 12/1999 | Moody | |
| 6,050,658 | A | 4/2000 | O'Sullivan et al. | |
| 6,062,979 | A | 5/2000 | Inoue | |
| 6,098,985 | A | 8/2000 | Moody | |
| 6,120,378 | A | 9/2000 | Moody et al. | |
| 6,149,521 | A | 11/2000 | Sanduski | |
| 6,176,781 | B1 | 1/2001 | Walker et al. | |
| 6,179,711 | B1 | 1/2001 | Yoseloff | |
| 6,193,235 | B1 | 2/2001 | Vancura et al. | |
| 6,196,547 | B1 | 3/2001 | Pascal et al. | |
| 6,213,877 | B1 | 4/2001 | Walker et al. | |
| 6,248,016 | B1 | 6/2001 | Walker et al. | |
| 6,257,979 | B1 | 7/2001 | Walker et al. | |
| 6,311,978 | B1 | 11/2001 | Moody | |
| 6,328,649 | B1 | 12/2001 | Randall et al. | |
| 6,334,613 | B1 | 1/2002 | Yoseloff | |
| 6,371,851 | B1 | 4/2002 | Singer et al. | |
| 6,406,023 | B1 | 6/2002 | Rowe | |
| 6,419,578 | B1 | 7/2002 | Moody et al. | |
| 6,422,940 | B1 | 7/2002 | Walker et al. | |
| 6,474,645 | B2 | 11/2002 | Tarantino | |
| 6,517,074 | B1 | 2/2003 | Moody et al. | |
| 6,523,829 | B1 | 2/2003 | Walker et al. | |
| 6,561,898 | B2 | 5/2003 | Moody | |
| 6,561,904 | B2 | 5/2003 | Locke et al. | |
| 6,568,680 | B1 | 5/2003 | Moody et al. | |
| 6,569,013 | B1 | 5/2003 | Taylor | |
| 6,612,927 | B1 | 9/2003 | Slomiany et al. | |
| 6,638,163 | B2 | 10/2003 | Moody | |
| 6,652,377 | B1 | 11/2003 | Moody | |
| 6,672,959 | B2 | 1/2004 | Moody et al. | |
| 6,726,427 | B2 | 4/2004 | Jarvis et al. | |
| 6,729,961 | B1 | 5/2004 | Millerschone | |
| 6,811,486 | B1 * | 11/2004 | Luciano, Jr. | 463/24 |
| 6,857,957 | B2 | 2/2005 | Marks et al. | |
| 6,916,245 | B1 | 7/2005 | Vancura et al. | |
| 6,935,950 | B2 | 8/2005 | Tarantino | |
| 6,955,356 | B2 | 10/2005 | Moody | |
| 6,964,418 | B2 | 11/2005 | Moody | |
| 6,991,538 | B2 | 1/2006 | Cannon | |
| 6,994,624 | B2 | 2/2006 | Gold et al. | |
| 7,056,207 | B2 | 6/2006 | Walker et al. | |
| 7,059,965 | B2 | 6/2006 | Jackson | |
| 7,137,628 | B2 | 11/2006 | Moody | |
| 7,156,397 | B2 | 1/2007 | Moody et al. | |
| 7,156,734 | B1 | 1/2007 | Walker et al. | |
| 7,201,655 | B2 | 4/2007 | Walker et al. | |
| 7,222,857 | B2 | 5/2007 | Moody | |
| 7,222,858 | B2 | 5/2007 | Moody | |
| 7,247,091 | B2 | 7/2007 | Moody | |
| 7,247,092 | B2 | 7/2007 | Jarvis et al. | |
| 7,250,001 | B2 | 7/2007 | Baerlocher et al. | |
| 7,258,611 | B2 | 8/2007 | Bigelow, Jr. et al. | |
| 7,297,057 | B2 | 11/2007 | Gerrard et al. | |
| 7,306,518 | B2 | 12/2007 | Hughs-Baird et al. | |
| 7,331,863 | B2 | 2/2008 | Baerlocher | |
| 7,338,370 | B2 | 3/2008 | Oles et al. | |
| 7,354,344 | B2 | 4/2008 | Paulsen et al. | |
| 7,404,762 | B2 | 7/2008 | Moody | |
| 7,416,186 | B2 | 8/2008 | Walker et al. | |
| 7,419,162 | B2 | 9/2008 | Lancaster et al. | |
| 7,431,644 | B2 | 10/2008 | Moody | |
| 7,488,251 | B2 | 2/2009 | Kaminkow | |
| 7,524,243 | B2 | 4/2009 | Bansemer et al. | |
| 7,566,271 | B2 | 7/2009 | Hostetler et al. | |
| 7,614,946 | B2 | 11/2009 | Nicely | |
| 7,641,197 | B2 | 1/2010 | Jackson | |
| 7,658,672 | B1 | 2/2010 | Wolf et al. | |
| 7,748,714 | B2 | 7/2010 | Nicely et al. | |
| 7,749,059 | B2 | 7/2010 | Tarantino | |
| 7,771,274 | B2 | 8/2010 | Walker et al. | |
| 7,785,188 | B2 | 8/2010 | Cannon | |
| 7,803,041 | B2 | 9/2010 | Gold et al. | |
| 7,803,043 | B2 | 9/2010 | Jackson | |
| 7,815,500 | B2 | 10/2010 | Montross et al. | |
| 7,819,740 | B2 | 10/2010 | Masci et al. | |
| 7,837,545 | B2 | 11/2010 | Blair, Jr. et al. | |
| 7,857,693 | B1 | 12/2010 | Johnson et al. | |
| 7,867,073 | B2 | 1/2011 | Walker et al. | |
| 7,914,369 | B2 | 3/2011 | Walker et al. | |
| 7,918,724 | B2 | 4/2011 | Walker et al. | |
| 7,922,575 | B2 | 4/2011 | Jankowski | |
| 8,029,358 | B2 | 10/2011 | Bigelow, Jr. et al. | |
| 8,062,119 | B2 | 11/2011 | Stern et al. | |
| 8,083,578 | B2 | 12/2011 | Jackson | |
| 8,092,290 | B2 | 1/2012 | Darby | |
| 8,118,662 | B2 | 2/2012 | Caputo et al. | |
| 8,137,174 | B2 | 3/2012 | Nicely et al. | |
| 8,177,620 | B2 | 5/2012 | Miles et al. | |
| 8,235,780 | B2 | 8/2012 | Nicely | |
| 8,235,781 | B2 | 8/2012 | Moody | |
| 8,235,801 | B2 | 8/2012 | Tan | |
| 8,262,448 | B2 | 9/2012 | Nicely et al. | |
| 8,262,455 | B2 | 9/2012 | Caputo et al. | |
| 8,272,940 | B2 | 9/2012 | Cuddy et al. | |
| 8,353,751 | B2 | 1/2013 | Bickley et al. | |
| 8,408,984 | B2 | 4/2013 | Walker et al. | |
| 8,434,764 | B2 | 5/2013 | Walker et al. | |
| 8,444,465 | B2 | 5/2013 | Macaulay | |
| 8,449,362 | B2 | 5/2013 | Jackson | |
| 8,460,094 | B2 | 6/2013 | Bigelow, Jr. et al. | |
| 2003/0027626 | A1 | 2/2003 | Marks et al. | |
| 2003/0216165 | A1 | 11/2003 | Singer et al. | |
| 2004/0152498 | A1 | 8/2004 | Kaminkow et al. | |
| 2005/0130737 | A1 * | 6/2005 | Englman et al. | 463/25 |
| 2005/0170876 | A1 | 8/2005 | Masci et al. | |
| 2006/0068884 | A1 | 3/2006 | Baerlocher et al. | |
| 2008/0111309 | A1 | 5/2008 | Nicely et al. | |
| 2009/0124326 | A1 | 5/2009 | Caputo et al. | |
| 2010/0004051 | A1 | 1/2010 | Walker et al. | |
| 2011/0014963 | A1 | 1/2011 | Walker et al. | |
| 2012/0129589 | A1 | 5/2012 | Caputo et al. | |

* cited by examiner

CASINO GAME WITH NEXT ROUND MULTIPLIERS

CROSS-REFERENCE TO RELATED APPLICATIONS

This application is based on and claims the benefit of U.S. provisional patent application Ser. No. 60/875,812, filed Dec. 18, 2006, the disclosure of which is incorporated herein in its entirety and U.S. provisional patent application Ser. No. 60/986,627, filed Nov. 9, 2007, the disclosure of which is incorporated herein in its entirety.

BACKGROUND OF THE INVENTION

This invention relates primarily to casino games, and more particularly to casino games such as video poker, keno and slot machines. The present invention provides the player with multipliers on the next round of play depending on the outcome of the previous round of play.

Conventional video draw poker is a single player game in which the player does not play against a dealer or other players, but rather merely tries to achieve the highest possible ranking poker hand.

After an initial deal of five cards, the player is allowed to discard and replace unwanted cards with replacement cards. Electronic video poker games use poker hand rankings to determine winning combinations and a payout schedule is used to determine the amount awarded to the player for achieving a winning combination.

The conventional winning poker hand rankings that are used in video poker in order from highest to lowest are: Royal Flush, Straight Flush, Four of a Kind, Full House, Flush, Straight, Three of a Kind, Two Pair and a Pair of Jacks or better. Any hand having less than a Pair of Jacks or better is a losing hand. These winning poker hand rankings are used in the Jacks or Better draw poker format as well as many of the other draw poker formats.

Video poker as a draw poker game using the Jacks or Better draw poker format has been played in gaming casinos for many years. Variations of video draw poker have evolved and include video draw poker using Jokers as wild cards and video draw poker using Deuces (or even Sevens) as wild cards. Another known variation of video draw poker is the Tens or Better format in which the lowest winning hand combination is a Pair of Tens. Most of the more recent modifications to video involve the use of different draw poker formats such as Bonus Poker, Double Bonus Poker, Double-Double Bonus Poker and even Triple Bonus Poker. Different draw poker formats involve changes to the pay table and often involve using different poker hand rankings as winning hand combinations.

Multiple hand video poker games allow the player to play more than one hand of video poker at a time. U.S. Pat. No. 5,823,873 to Moody, the disclosure of which is incorporated herein by reference, discloses a multiple hand poker game in which the player plays two or more hands of video poker at a time. An initial starting hand is dealt, the player discards unwanted cards and replacement cards are dealt for the discarded cards. The poker hand ranking of the final cards is determined and the player receives a payout for any winning card combination achieved. Each hand of the multiple hand poker game is treated as a separate pay line for payout purposes. However, each pay line uses the same pay table for the purpose of determining the amount received by the player for winning hands.

U.S. Pat. No. 6,638,163 (Moody) discloses a stud poker game with consecutive rounds of play. In either a single hand format or a multiple hand format, the play makes a wager to start the game. As long as the player continues to achieve winning outcomes, the play continues to receive additional rounds of stud poker without having to make any additional wagers. No pay table multipliers are disclosed in this method of play.

U.S. Pat. No. 6,149,521 (Sanduski) discloses randomly applying a multiplier to a pay line based on the value of a multiplier card. Sanduski discloses using only a single multiplier value for a single hand of video poker. For example, when a player achieves a Four-of-a-Kind, the payout for this winning combination is multiplied by the value of the kicker card in the poker hand. There is no carryover effect of any multiplier in the Sanduski game to the next round of play of the game.

U.S. Pat. No. 7,247,092 (Jarvis et al.), the disclosure of which is incorporated herein by reference, discloses the use of one or more multiplier cards added to a conventional deck of playing cards. Whenever a multiplier card appears during the play of a video poker game, the payout for any winning combination that is achieved is multiplied by the value of the multiplier card. This Jarvis feature has been commercialized in a game known as SUPER TIME PAY which is marketed by IGT of Reno, Nev. There is no carryover effect of any multiplier in the Jarvis game to the next round of play of the game.

The Jarvis multiplier card feature has been applied to multiple hand video poker. For example, in TRIPLE PLAY SUPER TIMES PAY all pay lines are eligible for the same multiplier value should a multiplier card appear in the initial deal of the starting hand. There is no carryover effect of any multiplier in the TRIPLE PLAY SUPER TIMES PAY game to the next round of play of the game.

U.S. Pat. No. 6,612,927 (Slomiany et al.) discloses a multiple hand poker game using multipliers. The player wagers to play four hands of video poker. The first hand is played at a 1× pay table. If the player has a winning outcome on the first hand, the player plays the second hand at a 2× multiplier. If the player has a winning outcome on the second hand, the player plays the third hand at a 4× multiplier. If the player has a winning outcome on the third hand, the player plays the fourth hand at an 8× multiplier. The multipliers from hand to hand always remain in the same progression of 1×, 2×, 4× and 8×.

U.S. Pat. No. 6,569,013 (Taylor) discloses a poker game which uses varying pay tables. As the player achieves a winning outcome on each consecutive round of play, the pay table changes for the next round of play. When the player achieves a losing outcome on a round of play, the pay table resets to the base pay table for the next round of play.

Slot machines also have one or more pay lines and for each pay line that has been activated by making a wager thereon, a player receives a payout whenever a winning symbol combination that appears on an active pay line.

U.S. Pat. No. 6,120,378 to Moody, the disclosure of which is incorporated herein by reference, discloses a multiple reel slot machine with multiple pay lines. The player makes a wager for each pay line that the player wishes to have activated for a particular round of play. The method of the present invention may be practiced using the slot machine disclosed in this '378 patent as well as other slot machines which have multiple pay lines.

The present invention provides a method for applying multipliers on the next round of play of a casino game based on the outcome of the previous round of play thereby adding a new and exciting wagering and winning feature for the player.

The method of the present invention can be applied to draw poker games and to slot machines. Stud poker games and keno games may also be modified to use the method of the present invention.

SUMMARY OF THE INVENTION

A player plays a first round of a casino game. If the player achieves a winning outcome on the first round of play, the payouts for the next round of play of the same casino game will be increased. The amount of the increase is based on the category of the winning outcome on the first round of play. Each subsequent round of play continues to have increased payouts if the player continues to achieve winning outcomes. When the player has a losing outcome, the payouts revert to the base level. An extra wager may be required from the player to activate this feature during the play of the casino game.

DETAILED DESCRIPTION OF THE PREFERRED EMBODIMENTS

The present invention relates to casino games such as video poker draw and stud games, keno games and slot machines.

Figure 1:
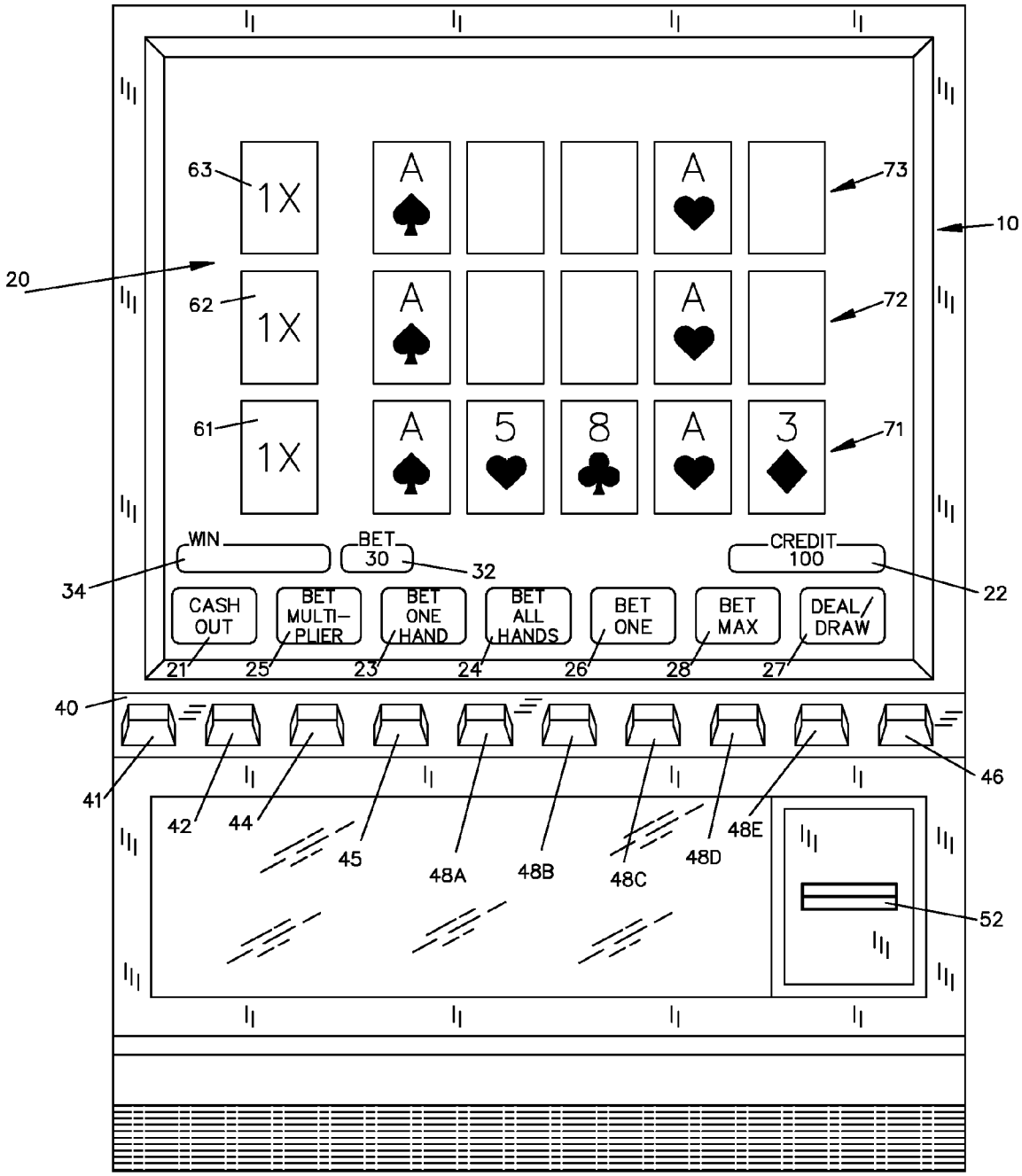
FIG. 1 shows a video poker machine configured to practice the present invention showing a representative initial deal of the cards of a multiple hand poker game for the first round of play.

FIG. 1 shows generally at 10 a typical electronic video poker machine that is configured to provide to the player the method of the present invention. A portion of the poker machine 10 includes a conventional video screen display 20 upon which the play of the poker game is shown.

The poker machine 10 also includes a conventional currency/ticket acceptor 52 by which the player can insert currency or tickets to add credits to a credit meter 22. It is also possible to provide a conventional coin head (not shown) to allow the player to add credits or make wagers by using coins or gaming tokens.

As is also conventional in electronic video poker machines, the credit meter 22 is provided to show the amount of credits that the player has accrued on the gaming machine 10—either by inserting coins, tokens, currency or tickets or from winning plays achieved by the player. Whenever the player makes a wager, the amount of the wager is decremented from the credit meter 22. Whenever the player achieves a winning play during the play of the game, the amount of the winning play is incremented on the credit meter 22.

A conventional payout hopper may also be located on the interior of the gaming machine and is used to dispense coins or tokens to the player into a payout tray (not shown) when the player wishes to collect any winning amounts the player has accrued. Other suitable and conventional payout mechanisms can be used, such as a ticket printer or other cashless payout devices.

A button panel 40 is also provided on the poker machine 10 and the buttons mounted on the button panel 40 are used by the player to control the operation of the poker machine 10. Any suitable configuration of the buttons on the button panel can be used and, alternatively, conventional touch screen technology can be used for any or all of the buttons mounted on the button panel.

A typical button arrangement is shown on the button panel 40 in FIG. 1. A "BET ONE" button 42 is provided to allow the player to wager one credit at a time. A "BET MAX" button 44 is provided to allow the player to wager the maximum amount of credits permitted by the configuration of the gaming machine 10. Any number of credits can be set as the maximum amount that it is possible to wager on each hand and, typically, five credits will be the maximum number of credits for any particular hand. Alternatively or additionally, a "BET ONE" location 26 and a "BET MAX" location 28 can be provided on the video screen 20 to allow the player to wager by using conventional touch screen technology.

The button panel 40 also includes a "CASH OUT" button 41 by which the player can effect the cashing out of any credits accrued on the credit meter 22. A touch screen "CASH OUT" location 21 may also be provided.

A conventional "DEAL/DRAW" button 46 is also provided on the button panel 40 which is used by the player to activate the initial deal of the cards at the deal stage of the method of play or the dealing of replacement cards at the draw stage of the method of play as is appropriate. Similarly, a DEAL/DRAW location 27 can be provided on the video screen 20 to allow the player to effect either the deal step or the draw step by using conventional touch screen technology.

The button panel 40 is also provided with five "CARD" buttons 48A, 48B, 48C, 48D and 48E associated with each horizontal card location on the video screen display: card button 48A is associated with the left most card location, card button 48B is associated with the second from the left card location, card button 48C is associated with the middle card location, card button 48D is associated with the second from the right card location and card button 48E is associated with the right most card location. Each card button is preferably aligned below the card locations so that the player can easily associate the appropriate card button with the appropriate card location. These card locations 48 are used by the player to select which cards to hold during the draw step of the poker game. Alternatively, the card locations on the video screen display 20 can be touch screen activated to allow the play to select which cards to hold by merely touching the card location on the video screen display 20.

A "BET ONE HAND" touch screen location 23 is provided on the video screen display 20 to allow the player to choose to play one hand of video poker. Each time the player presses the "BET ONE HAND" touch screen location 23 another hand of video poker is activated for that round of play. A "BET ALL HANDS" touch screen location 24 is also provided on the video screen display 20 to allow the play to activate all available hands of the multiple hand poker game with a single press. Associated buttons (not shown) may be provided on the button panel 40 to allow the player to bet one hand or to bet all hands.

The button panel 40 also includes a "BET MULTIPLIER" button 45 and an associated "BET MULTIPLIER" touch screen location 25 can be provided on the video screen display 20. This allows the player to activate the multiplier feature of the present invention during the play of the video poker game, if the use of the multiplier feature is optional during the play.

The video screen display 20 also has a "BET" location 32 that shows the amount of credits that have been wagered on a particular round of play and a "WIN" location 34 that shows the amount of credits won by the player on a particular round of play.

Each electronic video poker game is designed to be played by having one or more poker hands displayed on a video screen to a player. These are "player's hand only" poker games in which the player does not play against a dealer's hand or against other players, but merely attempts to achieve a winning poker hand combination using the player's final cards of the hand. Awards are made for winning final hand combinations based on the amount wagered by the player and the payouts that are displayed in a pay table.

An initial deal of cards comprises the player's initial hand. By manipulating the buttons on the gaming device or by using conventional touch screen technology, the player selects which cards he wishes to hold in his hand and thus which cards he wishes to discard. Replacement cards are then displayed for the discarded cards and the outcome of the play of the hand is determined. The resulting poker hand ranking of the final hand is then compared to a pay table to determine whether the player has a winning hand combination.

The method of the present invention will now be described. An initial hand is displayed to the player. The player is then allowed to discard any unwanted cards from the initial hand. Replacement cards for the discarded cards are displayed which results in a final hand. If the final hand has a winning card combination, the awards that can be won by the player on the next round of play are modified by an amount associated with the poker hand category of the winning card combination that was achieved in the final hand in the first round of play.

After the player has inserted an appropriate amount of coins, tokens, currency or tickets to add a sufficient amount of credits on the credit display meter 22, the player makes his initial wager. The player may press the "BET ONE" button 42 one or more times to bet in single increments or the player may merely press the "BET MAX" button 44 and the maximum number of credits are applied, for example, five credits are wagered on each of the three hands to be played and an additional five credits are wagered on each of the three hands to be played to activate the multiplier feature. The player can also use the touch screen locations to make his wager as described above.

As shown in FIG. 1, a player has made a thirty credit wager shown in the "BET" location 32. This activates three hands to be played HAND ONE 71, HAND TWO 72 and HAND THREE 73: five credits are allocated as the amount wagered on each hand and the additional five credits are required for the multiplier feature on each hand. In the preferred embodiment of the present invention, a player must make an extra wager to be eligible for the multiplier feature. The amount of the extra wager relates to the frequency and amount of the multipliers applied to the various pay lines. In a preferred embodiment of the present invention, the amount of the extra wager is equal to the amount of the wager made on a hand, although higher or lower amounts for the extra wager may be used. Alternatively, no extra wager could be required for the multiplier feature, but the pay table would have to be adjusted for the increased payouts that would come from the multiplier feature.

In the present invention, the multiplier feature does not apply to the present round of play, but applies to the next round of play. The player is making this wager on the present round of play to earn the possibility of receiving multipliers on the next round of play. At any point during the play of the game, if the player does not make the extra wager for a particular round of play, then the next round of play will occur at the base pay table having only a 1× multiplier.

Because FIG. 1 shows the initial first round of play, there is only a 1× multiplier on each hand. As shown in FIG. 1, a 1× multiplier 61 applies for HAND 71, a 1× multiplier 62 applies for HAND 72 and a 1× multiplier 63 applies for HAND 73. The payouts for any winning card combinations that are achieved on each of these pay lines are paid according to the associated pay table with only a 1× multiplier applied to those payouts. As discussed below, any multipliers that are earned during this first round of play are applied to the pay table for the next round of play.

The poker game shown in FIG. 1 as an example is a three hand poker game played in accordance with the method disclosed in U.S. Pat. No. 5,873,823.

The player has been dealt a first HAND 71 of the Ace of Spades, Five of Hearts, Eight of Clubs, Ace of Hearts and Three of Diamonds. The player has selected to hold the Ace of Spades and the Ace of Hearts and these two cards are duplicated into second HAND 72 and third HAND 73.

Figure 2:
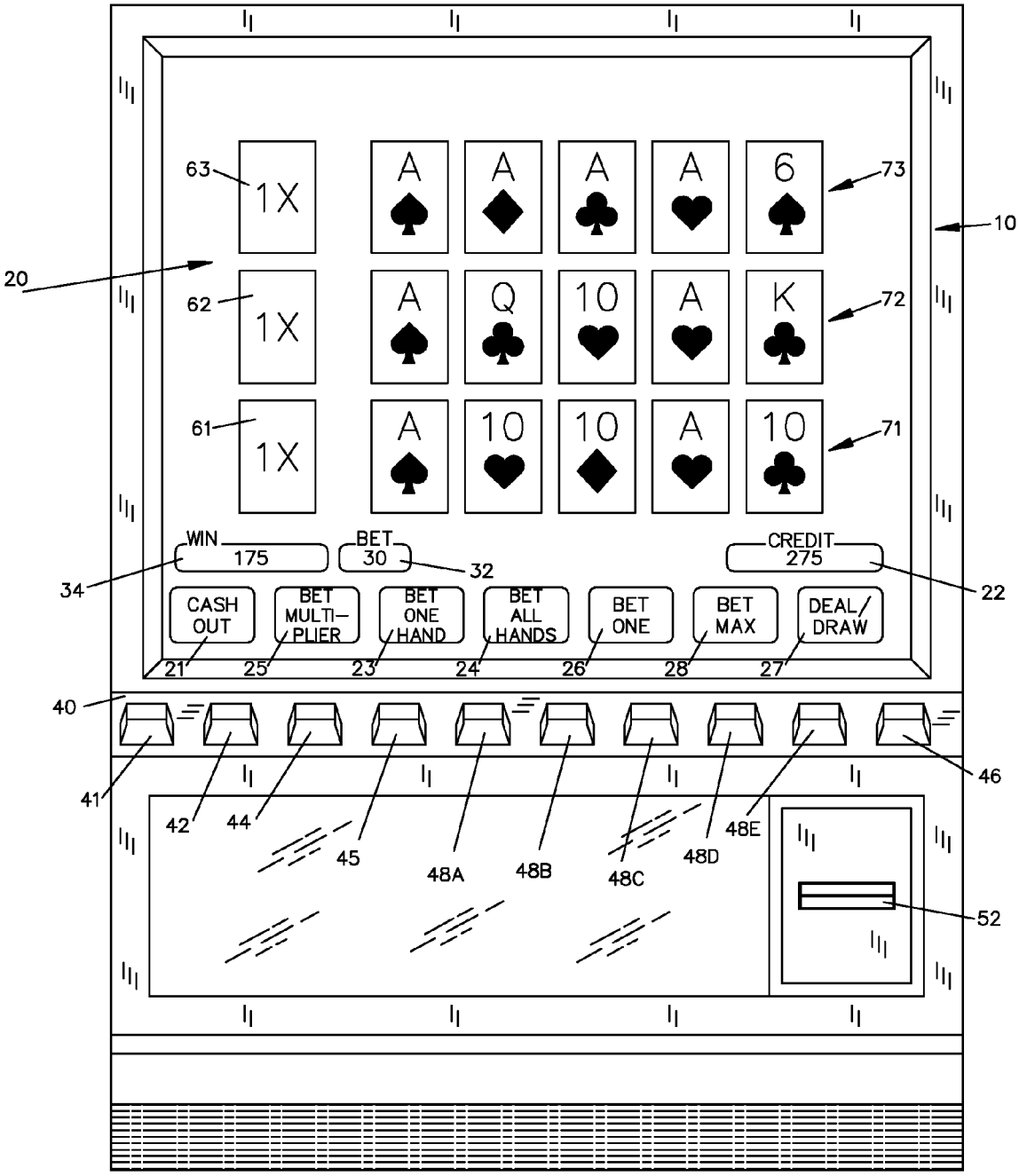
FIG. 2 shows a video poker machine configured to practice the present invention showing a representative display of the final hands of a multiple hand poker game for the first round of play.

As shown in FIG. 2, replacement cards for the discarded cards of first HAND 71 are displayed and the final first HAND 71 has a poker hand combination of a Full House. Additional cards are displayed into second HAND 72 and the final second HAND 72 has a poker hand combination of a Pair of Aces. Additional cards are displayed into third HAND 73 and the final third HAND 73 has a poker hand combination of Four Aces.

A pay table is displayed to the player showing the amounts that the player can win based on the poker hand ranking achieved by the player and the amount wagered by the player.

In the example shown in FIGS. 1 and 2, a Jacks or Better draw poker game format is used. A suitable pay table for this format would be:

TABLE 1

| DRAW POKER | | | | | |
|---|---|---|---|---|---|
| | NUMBER OF COINS BET | | | | |
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE-OF-A-KIND | 3 | 6 | 9 | 12 | 15 |
| TWO PAIR | 2 | 4 | 6 | 8 | 10 |
| JACKS OR BETTER | 1 | 2 | 3 | 4 | 5 |

Using the pay table shown in Table 1, final HAND 71 is a winning combination of a Full House and the player would receive forty-five credits as a payout based on the 1× multiplier 61. Final HAND 72 is a winning combination of Jacks or Better and the player would receive five credits as a payout based on the 1× multiplier 62. Final HAND 73 is a winning combination of Four-of-a-Kind and the player would receive one hundred twenty-five credits as a payout based on the 1× multiplier 63.

The multipliers to be applied to each hand in round two of the game are also determined based on the outcome of each hand in the first round. The multipliers are based on the various poker hand categories that are designated as winning hand combinations for the poker format being used. A multiplier table is used and could be displayed to the player on the video screen display 20, on a second screen display or printed on the glass of the gaming machine. Any suitable multiplier table could be used. An exemplary multiplier table is shown in Table 2.

TABLE 2

| | |
|---|---|
| ROYAL FLUSH | 10× |
| STRAIGHT FLUSH | 10× |
| FOUR-OF-A-KIND | 10× |
| FULL HOUSE | 6× |
| FLUSH | 6× |
| STRAIGHT | 5× |
| THREE-OF-A-KIND | 4× |
| TWO PAIR | 4× |
| JACKS OR BETTER | 2× |

Figure 3:
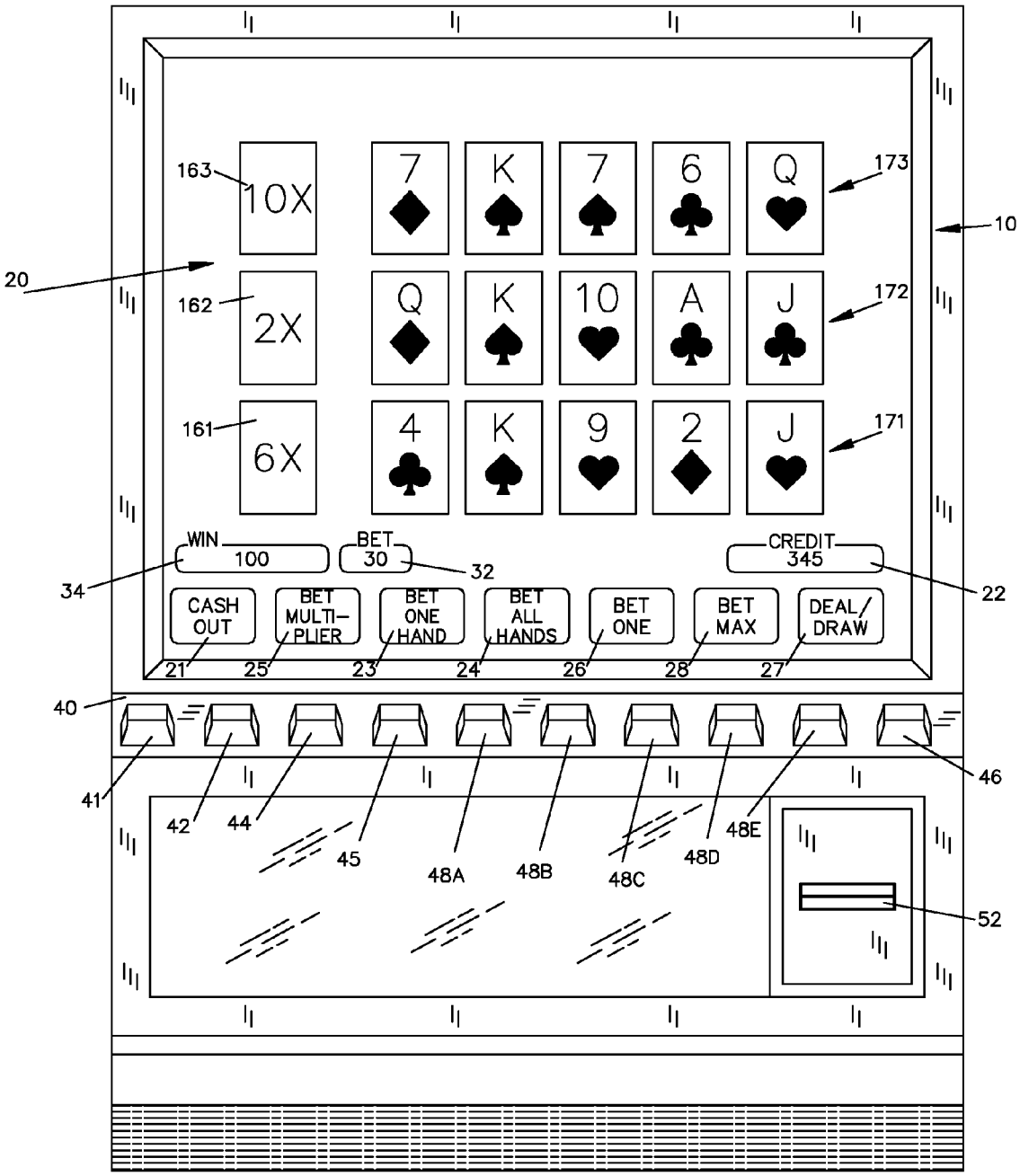
FIG. 3 shows a video poker machine configured to practice the present invention showing the multiplier feature as applied for the second round of play.

Using the multiplier table shown in Table 2, the winning outcome for a poker hand category of a Full House in HAND ONE 71 results in a 6× multiplier shown at 161 in FIG. 3 and applied to HAND ONE 171 in the next round of play. Likewise, the winning outcome for a poker hand category of Jacks or Better in HAND TWO 72 results in a 2× multiplier shown at 162 in FIG. 3 and applied to HAND TWO 172 in the next round of play. The winning outcome for a poker hand category of Four-of-a-Kind in HAND THREE 73 results in a 10× multiplier shown at 163 in FIG. 3 and applied to HAND THREE 173 in the next round of play.

Figure 4:
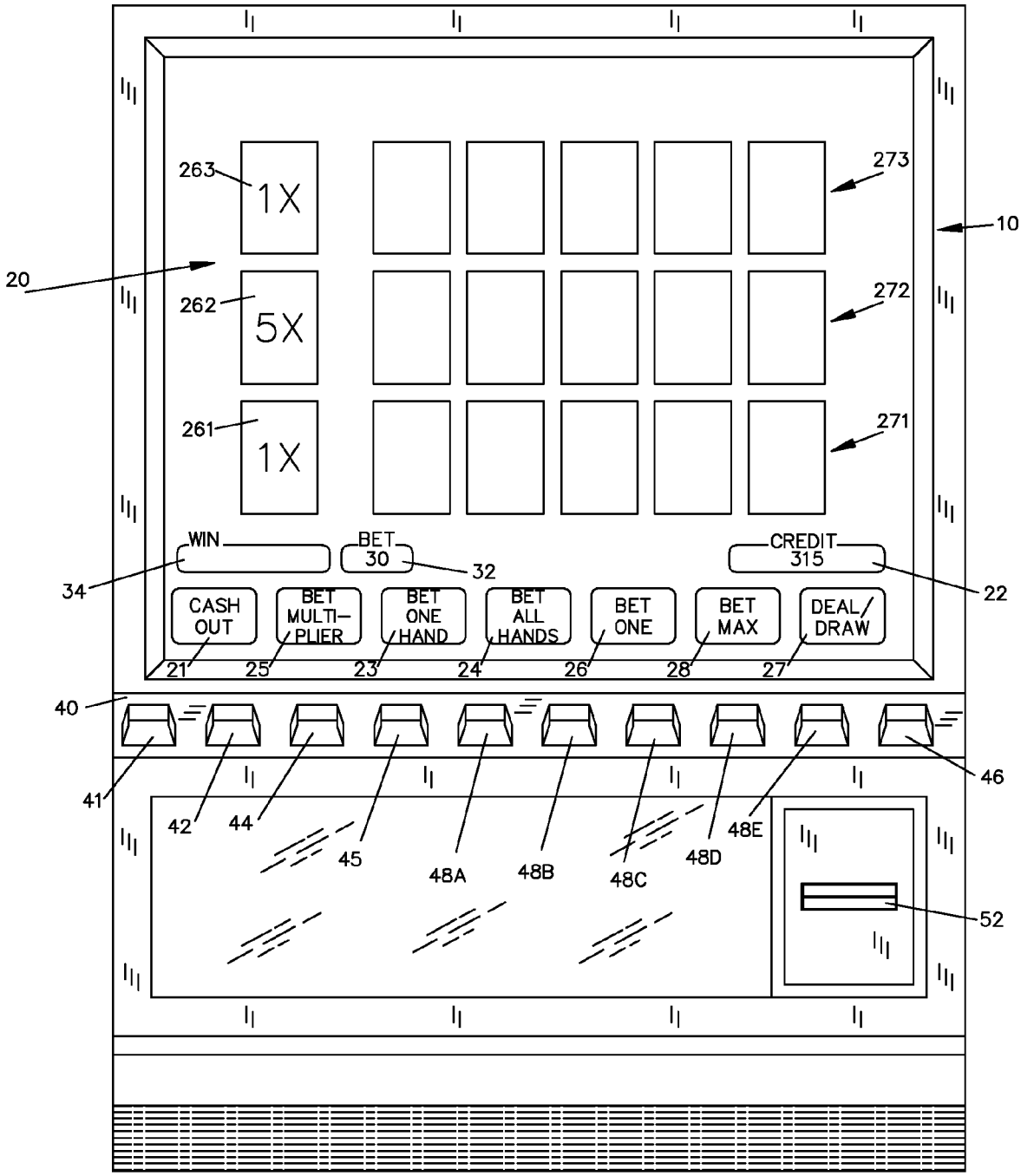
FIG. 4 shows a video poker machine configured to practice the present invention showing the multiplier feature as applied for the third round of play.

When the next round of play is conducted, the player would again make a wager of thirty credits and a round of video poker would be played. By making this thirty credit wager, the player is activating the multiplier feature for the next round of play. As the example in FIG. 3 shows, the player achieved a losing outcome in HAND ONE 171 so the multiplier feature reverts to 1× as shown in FIG. 4 at 261 for HAND ONE 271. The player achieved a winning outcome for a poker hand category of a Straight in HAND TWO 162 so the multiplier feature shows a 5× multiplier as shown in FIG. 4 at 262 for HAND TWO 272. Also, the player achieved a losing outcome in HAND THREE 173 so the multiplier feature reverts to 1× as shown in FIG. 4 at 263 for HAND THREE 273.

This progression of multipliers continues from round to round as long as the player continues to make the wager for the multiplier feature in the embodiment of the present invention which requires that the player make a wager to activate the multiplier feature.

Whenever the player achieves a losing hand combination on any hand of play, then the next hand of play would be played at the normal 1× payout.

While the examples shown in FIGS. 1 through 4 use a regular Jacks or Better draw poker format pay table, other pay tables have been developed for the other variations of draw poker, such as Deuces Wild Poker, Bonus Poker, Double Bonus Poker, Double Double Bonus Poker, Triple Bonus Poker, Joker's Wild Poker or any of the myriad of video poker formats that have been developed. Each of these video poker formats uses various arrangements of poker hand rankings as winning combinations and they use various payout amounts for the poker hand rankings. The amounts paid for the various winning hand combinations in each of the video poker formats are calculated to provide a certain theoretical game return based on the mathematical probability of achieving the winning hand combinations and the theoretical hold percentage that the casino wishes to offer to the players.

The method of the present invention can be applied to any of the various video poker formats that are available or can be created for use.

The multipliers for a poker hand category can also be varied as desired and can be applied to some or all of the poker hand categories that are winning hand combinations for the poker format being used.

While the example given above has been described in connection with a three hand video poker game, the present invention can also be applied to a single hand video poker game, or to any number of multiple hand video poker games.

The present invention can also be applied to stud poker games, keno games and slot machine games or any other casino game that uses a pay table.

The present invention has been described above in connection with a multiple hand draw poker game with the example using a three hand poker game. However, the multiplier feature of the present invention can also be used in single hand or single reel games or in any game that has two or more hands or reels.

While the invention has been illustrated with respect to several specific embodiments thereof, these embodiments should be considered as illustrative rather than limiting. Various modifications and additions may be made and will be apparent to those skilled in the art.

What is claimed is:

1. A method of operating a gaming machine, said method comprising:

(i) if a physical item associated with a monetary value is received via an acceptor supported by a housing of the gaming machine, identifying, via the acceptor, the received physical item and causing a processor to establish a credit balance based at least in part on the monetary value associated with the received and identified physical item;

(ii) if a wager button is actuated, causing the processor to place a first round wager on a first round of play of a card game and initiate the first round of play of the card game, the credit balance being decreasable by the first round wager;

(iii) for the first round of play of the card game:

(a) causing a processor to randomly select an initial hand of cards from a virtual deck of at least fifty-two cards;

(b) causing the processor to operate with a display device to display the initial hand of cards;

(c) causing the processor to operate with an input device to receive a selection of any cards of the initial hand of cards to hold;

(d) causing the processor to form a final hand of cards by:

(1) operating with the display device to discard any non-held cards of the initial hand of cards;

(2) for each of any discarded cards, randomly selecting a replacement card from the cards remaining in the virtual deck of cards, and (3) operating with the display device to display any such replacement cards;

(e) causing the processor to determine one of a plurality of different poker hand categories of the final hand; and (f) when the poker hand category of the final hand is one of a plurality of different winning poker hand categories:

(1) causing the processor to determine an award for said final hand based at least in part on the final hand, a paytable, and any multiplier determined in a prior round of play, the paytable including, for each winning poker hand category, an award associated with said winning poker hand category, the credit balance being increasable by the award;

(2) providing the determined award; and (3) causing the processor to determine a multiplier that is usable in a next round of play based at least in part on the final hand and a multiplier table, the multiplier table including, for each winning poker hand category, a multiplier associated with said winning poker hand category;

(iv) providing the next round of play using any determined multiplier from the first round of play, any determined multiplier being applied to at least one winning poker hand category in the paytable for said next round of play; and (v) if a cashout button is actuated, causing the processor to initiate a payout associated with the credit balance.

2. The method of claim 1, which includes providing (iii)(f)(3) if a secondary wager is placed in addition to said first round wager for the first round of play of the card game.

3. The method of claim 2, which includes providing (iv) if the secondary wager is placed in addition to a next round wager placed for the next round of play of the card game.

4. The method of claim 3, which includes providing the next round of play of the card game without using any determined multiplier from the first round of play if the secondary wager is not placed in addition to the next round wager.

5. The method of claim 1, wherein a first poker winning hand category is associated with a first multiplier and a second different poker winning hand category is associated with a second different multiplier.

6. The method of claim 5, wherein a probability of the final hand being of the first poker winning hand category is greater than a probability of the final hand being of the second poker winning hand category and the second multiplier is greater than the first multiplier.

7. The method of claim 1, which includes, when the final hand is a losing hand, causing the processor to not determine any multiplier used for the next round of play.

8. The method of claim 1, wherein the input device includes a touch screen, and wherein causing the processor to operate with the input device to receive the selection of any cards of the initial hand of cards to hold includes, for each held card of the initial hand of cards, receiving a touch in an area of the touch screen proximate said displayed held card.

9. The method of claim 1, wherein the input device includes a separate physical button associated with each card of the initial hand of cards, and wherein causing the processor to operate with the input device to receive the selection of any cards of the initial hand of cards to hold includes, for each held card of the initial hand of cards, receiving an actuation of the physical button associated with said held card.

10. A gaming machine comprising:

a housing;

a processor;

a display device supported by the housing;

a plurality of input devices supported by the housing, the plurality of input devices including an acceptor; and a memory device that stores a plurality of instructions that, when executed by the processor, cause the processor to operate with the display device and the plurality of input devices to:

(i) if a physical item associated with a monetary value is received via the acceptor, identify the received physical item via the acceptor and establish a credit balance based at least in part on the monetary value associated with the received and identified physical item;

(ii) if a wager button is actuated, place a first round wager on a first round of play of a card game and initiate the first round of play of the card game, the credit balance being decreasable by the wager;

(iii) for the first round of play of the card game:

(a) randomly select an initial hand of cards from a virtual deck of at least fifty-two cards;

(b) display the initial hand of cards;

(c) receive a selection of any cards of the initial hand of cards to hold;

(d) form a final hand of cards by:

(1) discarding any non-held cards of the initial hand of cards;

(2) for each of any discarded cards, randomly selecting a replacement card from the cards remaining in the virtual deck of cards, and (3) displaying any such replacement cards;

(e) determine one of a plurality of different poker hand categories of the final hand; and (f) when the poker hand category of the final hand is one of a plurality of different winning poker hand categories:

(1) determine an award for said final hand based at least in part on the final hand, a paytable, and any multiplier determined in a prior round of play, the paytable including, for each winning poker hand category, an award associated with said winning poker hand category, the credit balance being increasable by the award;

(2) display the determined award; and (3) determine a multiplier that is usable in a next round of play based at least in part on the final hand and a multiplier table, the multiplier table including, for each winning poker hand category, a multiplier associated with said winning poker hand category;

(iv) provide the next round of play using any determined multiplier from the first round of play, any determined multiplier being applied to at least one winning poker hand category in the paytable for said next round of play; and (v) if a cashout button is actuated, initiate a payout associated with the credit balance.

11. The gaming machine of claim 10, wherein the plurality of instructions, when executed by the processor, cause the processor to provide (iii)(f)(3) if a secondary wager is placed received in addition to said first round wager for the first round of play of the card game.

12. The gaming machine of claim 11, wherein the plurality of instructions, when executed by the processor, cause the processor to operate with the display device and the plurality of input devices to provide (iv) (ii) if the secondary wager is placed in addition to a next round wager placed for the next round of play of the card game.

13. The gaming machine of claim 12, wherein the plurality of instructions, when executed by the processor, cause the processor to operate with the display device and the plurality of input devices to provide the next round of play of the card game without using any determined multiplier from the first round of play if the secondary wager is not placed in addition to the next round wager.

14. The gaming machine of claim 10, wherein a first poker winning hand category is associated with a first multiplier and a second different poker winning hand category is associated with a second different multiplier.

15. The gaming machine of claim 14, wherein a probability of the final hand being of the first poker winning hand category is greater than a probability of the final hand being of the second poker winning hand category and the second multiplier is greater than the first multiplier.

16. The gaming machine of claim 10, wherein the plurality of instructions, when executed by the processor, cause the processor to, when the final hand is a losing hand, not determine any multiplier used for the next round of play.

17. The gaming machine of claim 10, wherein the plurality of input devices include a touch screen, and wherein the plurality of instructions, when executed by the processor, cause the processor to operate with the touch screen to receive the selection of any cards of the initial hand of cards to hold by, for each held card of the initial hand of cards, receiving a touch in an area of the touch screen proximate said displayed held card.

18. The gaming machine of claim 10, wherein the plurality of input devices include a separate physical button associated with each card of the initial hand of cards, and wherein the plurality of instructions, when executed by the processor, cause the processor to operate with the physical buttons to receive the selection of any cards of the initial hand of cards to hold by, for each held card of the initial hand of cards, receiving an actuation of the physical button associated with said held card.

* * * * *

UNITED STATES PATENT AND TRADEMARK OFFICE

CERTIFICATE OF CORRECTION

PATENT NO. : 9,138,634 B2
APPLICATION NO. : 11/958570
DATED : September 22, 2015
INVENTOR(S) : Moody It is certified that error appears in the above-identified patent and that said Letters Patent is hereby corrected as shown below:

IN THE CLAIMS

Claim 1, Column 8, Line 42, replace "a" with --the--.
Claim 10, Column 10, Line 4, between "the" and "wager" insert --first round--.
Claim 11, Column 10, Line 47, delete "received".
Claim 12, Column 10, Line 52, delete "(ii)".

Signed and Sealed this
Twenty-first Day of June, 2016

Michelle K. Lee

Michelle K. Lee
*Director of the United States Patent and Trademark Office*